US010088206B2

(12) United States Patent
Sakai et al.

(10) Patent No.: US 10,088,206 B2
(45) Date of Patent: Oct. 2, 2018

(54) AIR-CONDITIONING APPARATUS

(71) Applicant: Mitsubishi Electric Corporation, Tokyo (JP)

(72) Inventors: Mizuo Sakai, Tokyo (JP); Masanori Aoki, Tokyo (JP); Hirokuni Shiba, Tokyo (JP); Hiroaki Nakamune, Tokyo (JP); Hiroki Murakami, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 130 days.

(21) Appl. No.: 14/916,057

(22) PCT Filed: Aug. 4, 2014

(86) PCT No.: PCT/JP2014/070429
§ 371 (c)(1),
(2) Date: Mar. 2, 2016

(87) PCT Pub. No.: WO2015/056477
PCT Pub. Date: Apr. 23, 2015

(65) Prior Publication Data

US 2016/0216015 A1 Jul. 28, 2016

(30) Foreign Application Priority Data

Oct. 17, 2013 (JP) ..... 2013-216608

(51) Int. Cl.
*F25B 41/00* (2006.01)
*F25B 41/04* (2006.01)
(Continued)

(52) U.S. Cl.
CPC ..... *F25B 41/04* (2013.01); *F25B 13/00* (2013.01); *F25B 40/00* (2013.01); *F25B 49/02* (2013.01);
(Continued)

(58) Field of Classification Search
CPC .. F25B 41/04; F25B 49/02; F25B 2341/0662; F25B 2600/2523; F25B 2400/053; F25B 2600/2501; F25B 2400/054
See application file for complete search history.

(56) References Cited

U.S. PATENT DOCUMENTS 4,457,138 A * 7/1984 Bowman ..... F25B 49/02 62/196.1
4,646,541 A * 3/1987 Reid, Jr. ..... C09K 5/047 62/238.3
(Continued)

FOREIGN PATENT DOCUMENTS

CN 204154039 U 2/2015
JP 56-064256 A 6/1981
(Continued)

OTHER PUBLICATIONS

Chinese Office Action dated Oct. 9, 2016 in the corresponding CN application No. 201410547306.9 (English translation attached).
(Continued)

*Primary Examiner* — Len Tran
*Assistant Examiner* — Kamran Tavakoldavani
(74) *Attorney, Agent, or Firm* — Posz Law Group, PLC

(57) ABSTRACT

An air-conditioning apparatus controls a decrease in efficiency of a refrigeration cycle, and includes a suction pipe having one end connected to a suction side of a compressor and an other end connected to an evaporator, a receiver connected to a refrigerant pipe connecting the evaporator and a condenser to each other, a first bypass pipe having one end connected to the receiver and an other end connected to the suction pipe and configured to supply refrigerant from the receiver to the suction pipe, a flow control valve provided to the first bypass pipe, a heat recovery portion disposed downstream of a portion of the suction pipe connected to the first bypass pipe, and a control device
(Continued)

configured to control an opening degree of the flow control valve based on a degree of superheat of refrigerant in the heat recovery portion.

14 Claims, 4 Drawing Sheets

(51) Int. Cl.

| | |
|---|---|
| ***F25B 13/00*** | (2006.01) |
| ***F25B 49/02*** | (2006.01) |
| ***F25B 40/00*** | (2006.01) |
| *F25B 31/00* | (2006.01) |

(52) U.S. Cl.
CPC ..... *F25B 31/004* (2013.01); *F25B 2313/0233* (2013.01); *F25B 2341/0662* (2013.01); *F25B 2400/053* (2013.01); *F25B 2400/054* (2013.01); *F25B 2400/23* (2013.01); *F25B 2600/2509* (2013.01); *F25B 2700/21151* (2013.01); *F25B 2700/21175* (2013.01)

(56) References Cited

U.S. PATENT DOCUMENTS

| | | | | |
|---|---|---|---|---|
| 2003/0126875 | A1* | 7/2003 | Enomoto | F25B 40/00 62/217 |
| 2006/0080989 | A1* | 4/2006 | Aoki | F25B 13/00 62/324.4 |
| 2007/0199337 | A1* | 8/2007 | Otake | F24D 17/02 62/183 |
| 2012/0260688 | A1 | 10/2012 | Honda | |
| 2013/0098092 | A1* | 4/2013 | Wakamoto | F25B 1/10 62/278 |
| 2013/0133361 | A1* | 5/2013 | Yamashita | F25B 5/00 62/502 |
| 2013/0145791 | A1 | 6/2013 | Christensen | |

FOREIGN PATENT DOCUMENTS

| | | | |
|---|---|---|---|
| JP | 58-142657 | U | 8/1983 |
| JP | 09-145167 | A | 6/1997 |
| JP | 2001-174091 | A | 6/2001 |
| JP | 3719364 | B | 9/2005 |
| JP | 2012-193897 | A | 10/2012 |
| WO | 95/21359 | A1 | 8/1995 |

OTHER PUBLICATIONS

Office Action dated Jan. 3, 2017 issued in corresponding CN patent application No. 201410547306.9 (and English translation).
Chinese Office Action dated May 30, 2016 in the corresponding CN application No. CN201410547306.9(English translation attached).
International Search Report of the International Searching Authority dated Oct. 21, 2014 for the corresponding International application No. PCT/JP2014/070429 (and English translation).
Office Action dated May 31, 2016 in the corresponding JP Application No. 2013-216608 (with English translation).
Extended European Search Report dated May 18, 2017 issued in corresponding EP patent application No. 14853501.6.

* cited by examiner

AIR-CONDITIONING APPARATUS

CROSS REFERENCE TO RELATED APPLICATIONS

This application is a U.S. national stage application of International Application No. PCT/JP2014/070429 filed on Aug. 4, 2014, and is based on Japanese Patent Application No. 2013-216608 filed on Oct. 17, 2013, the disclosures of which are incorporated herein by reference.

TECHNICAL FIELD

The present invention relates to an air-conditioning apparatus.

BACKGROUND ART

There has been proposed an air-conditioning apparatus including a compressor, a four-way valve, a condenser, a receiver, an expansion valve, and an evaporator so that the receiver is disposed between the evaporator and the expansion valve (see, for example, Patent Literature 1). In a technique described in Patent Literature 1, a suction pipe connected to a suction side of a compressor is partially disposed in a receiver. This configuration causes refrigerant flowing in the suction pipe and refrigerant in the receiver to exchange heat, control an inflow of liquid refrigerant into the suction side of the compressor (liquid back), and enhances efficiency of a refrigeration cycle.

CITATION LIST

Patent Literature

Patent Literature 1: Japanese Unexamined Patent Application Publication No. 2001-174091 (see, for example, Abstract, Paragraph [0028], and FIG. 1)

SUMMARY OF INVENTION

Technical Problem

In the technique described in Patent Literature 1, a passage of gas refrigerant flowing out of the receiver is limited to a downstream pipe connected to the receiver. Thus, gas refrigerant is easily accumulated in the receiver.

(1) Specifically, in the technique described in Patent Literature 1, the amount of gas refrigerant accumulated in the receiver increases so that a predetermined amount of subcooled refrigerant may fail to be supplied toward a portion downstream of the receiver. This leads to a problem in that efficiency of a refrigeration cycle decreases.

(2) As another problem, when the amount of gas refrigerant accumulated in the receiver increases, the flow rate of refrigerant in an evaporator downstream of the receiver increases accordingly so that a pressure loss in the evaporator increases and the efficiency of the refrigeration cycle decreases.

(3) In addition, since gas refrigerant is easily accumulated in the receiver, the amount of gas refrigerant included in refrigerant flowing out of the receiver increases, disadvantageously. Specifically, in the technique described in Patent Literature 1, the amount of gas refrigerant flowing into the evaporator easily increases, and the degree of quality at an inlet of the evaporator increases accordingly, resulting in a decrease in heat exchange efficiency in the evaporator and, thereby, a decrease in the efficiency of the refrigeration cycle.

The present invention has been made to solve problems as described above, and provides an air-conditioning apparatus that can control a decrease in efficiency of a refrigeration cycle.

Solution to Problem

An air-conditioning apparatus according to the present invention includes a refrigeration cycle connecting a compressor, a condenser, an expansion valve, and an evaporator by refrigerant pipes; a suction pipe having one end connected to a suction side of the compressor and an other end connected to the evaporator; a receiver connected to a refrigerant pipe connecting the evaporator and the condenser to each other; a first bypass pipe having one end connected to the receiver and an other end connected to the suction pipe, and configured to supply refrigerant from the receiver to the suction pipe; a flow control valve provided to the first bypass pipe; a heat recovery portion disposed downstream of a portion of the suction pipe connected to the first bypass pipe, and configured to exchange heat between refrigerant flowing into the suction pipe from the evaporator and the first bypass pipe and refrigerant in the receiver; and a control device configured to control an opening degree of the flow control valve based on a degree of superheat of refrigerant in the heat recovery portion.

Advantageous Effects of Invention

The above-described configuration enables the air-conditioning apparatus according to the present invention to control a decrease in efficiency of the refrigeration cycle.

DESCRIPTION OF EMBODIMENTS

Embodiments of the present invention will be described hereinafter with reference to the drawings.

Embodiment 1

Figure 1:
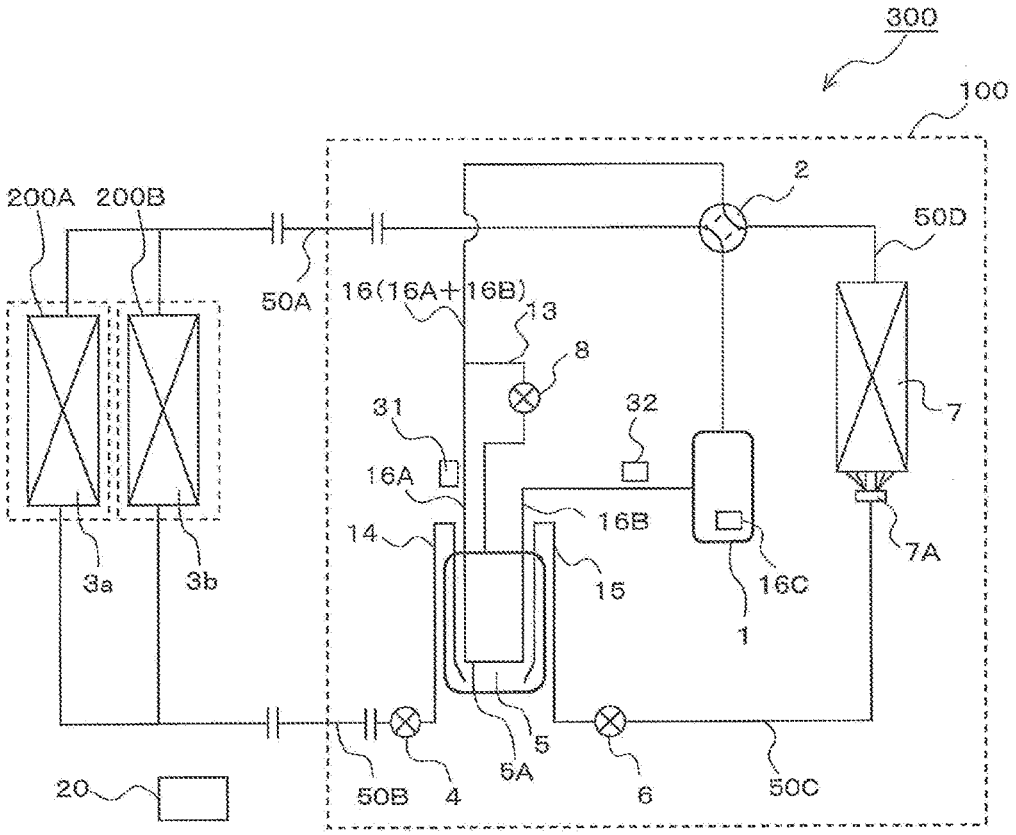
FIG. 1 illustrates an example of a refrigerant circuit configuration of an air-conditioning apparatus according to Embodiment 1 of the present invention.

FIG. 1 illustrates an example of a refrigerant circuit configuration of an air-conditioning apparatus 300 according to Embodiment 1.

The air-conditioning apparatus 300 according to Embodiment 1 has been improved to control a decrease in efficiency of a refrigeration cycle.

[Configuration]

The air-conditioning apparatus 300 includes an outdoor unit 100 placed in, for example, outdoors and indoor units 200A and 200B placed in, for example, air-conditioned space or space above a ceiling. The air-conditioning apparatus 300 also includes a refrigerant circuit in which a compressor 1, a four-way valve 2, an indoor heat exchanger 3*a*, an indoor heat exchanger 3*b*, a first expansion valve 4, a power receiver 5, a second expansion valve 6, an outdoor heat exchanger 7, a flow control valve 8, and other components are connected to one another by a suction pipe 16, a first bypass pipe 13, refrigerant pipes 50A to 50D, an indoor-side power receiver pipe 14, an outdoor-side power receiver pipe 15, and other components. The air-conditioning apparatus 300 also includes a control unit 20 for switching a connecting state of the four-way valve 2, for example, and first and second temperature sensors 31 and 32 for use in calculating the degree of superheat.

In the example illustrated in FIG. 1, the indoor unit 200 includes the two indoor units 200A and 200*a* However, the present invention is not limited to this example, and the indoor unit 200 may be one indoor unit or include three or more indoor units.

(Outdoor Unit 100)

The outdoor unit 100 includes the compressor 1, the four-way valve 2, the first expansion valve 4, the power receiver 5, the second expansion valve 6, the outdoor heat exchanger 7, and the flow control valve 8. The outdoor unit 100 is connected to the indoor unit 200A and the indoor unit 200B through the refrigerant pipe 50A and the refrigerant pipe 50B. The outdoor unit 100 includes an air-sending unit (not shown) that supplies air to the outdoor heat exchanger 7 and exchanges heat between the supplied air and refrigerant flowing in the outdoor heat exchanger 7. As the air-sending unit, a fan may be used.

(Indoor Unit 200A and Indoor Unit 200B)

The indoor unit 200A includes an indoor heat exchanger 3*a*. The indoor unit 200B includes an indoor heat exchanger 3*b*. The indoor unit 200A and the indoor unit 200B are connected to the outdoor unit 100 through the refrigerant pipe 50A and the refrigerant pipe 50B. The indoor unit 200A includes a fan (not shown) that supplies air to the indoor heat exchanger 3*a*, exchanges heat between the supplied air and refrigerant flowing in the indoor heat exchanger 3*a*, and supplies the resulting air to air-conditioned space (e.g., a room, a room in a building, or a warehouse). Similarly, the indoor unit 200B includes an unillustrated fan.

(Compressor 1)

The compressor 1 sucks refrigerant, compresses the refrigerant into a high-temperature high-pressure state, and discharges the refrigerant in this state. A refrigerant discharge side of the compressor 1 is connected to the four-way valve 2, and a refrigerant suction side of the compressor 1 is connected to the power receiver 5. The compressor 1 is preferably, for example, an inverter compressor.

(Four-Way Valve 2)

The four-way valve 2 is used for switching a channel of refrigerant. In a heating operation, the four-way valve 2 connects a discharge side of the compressor 1 to the indoor heat exchanger 3*a* and the indoor heat exchanger 3*b*, and connects a suction side of the compressor 1 to the outdoor heat exchanger 7. In a cooling operation, the four-way valve 2 connects the discharge side of the compressor 1 to the outdoor heat exchanger 7, and connects the suction side of the compressor 1 to the indoor heat exchanger 3*a* and the indoor heat exchanger b. The four-way valve 2 may be replaced by a combination of a plurality of two-way valves having a function similar to that of the four-way valve 2.

(Indoor Heat Exchanger 3*a* and Indoor Heat Exchanger 3*b*)

The indoor heat exchanger 3*a* and the indoor heat exchanger 3*b* serve as condensers (radiators) in the heating operation, and exchange heat between refrigerant discharged from the compressor 1 and air. The indoor heat exchanger 3*a* and the indoor heat exchanger 3*b* serve as evaporators in the cooling operation, and exchange heat between refrigerant that has flowed out of the first expansion valve 4 and air. One of the indoor heat exchanger 3*a* or the indoor heat exchanger 3*b* is connected to the four-way valve 2 through the refrigerant pipe 50A, and the other is connected to the first expansion valve 4 through the refrigerant pipe 50B. The indoor heat exchanger 3*a* and the indoor heat exchanger 3*b* are preferably plate fin-and-tube heat exchangers that can exchange heat between refrigerant flowing in the indoor heat exchanger 3*a* and the indoor heat exchanger 3*b* and air passing through fins.

(First Expansion Valve 4 and Second Expansion Valve 6)

The first expansion valve 4 and the second expansion valve 6 are used for expanding refrigerant. The first expansion valve 4 is connected to the indoor heat exchanger 3*a* and the indoor heat exchanger 3*b* at one end and is connected to the power receiver 5 at the other end. The second expansion valve 6 is connected to the power receiver 5 at one end and is connected to the outdoor heat exchanger 7 at the other end.

(Power Receiver 5)

The power receiver 5 can store liquid refrigerant and has a gas-liquid separation function. A liquid side of the power receiver 5 is connected to the first expansion valve 4 through the indoor-side power receiver pipe 14 and to the second expansion valve 6 through the outdoor-side power receiver pipe 15. A gas side of the power receiver 5 is also connected to the flow control valve 8 through the first bypass pipe 13. As illustrated in FIG. 1, the first bypass pipe 13 is connected to an upper portion of the power receiver 5.

The power receiver 5 is connected to the suction pipe 16 in so that the suction pipe 16 passes through the power receiver 5. A portion of the suction pipe 16 located inside the power receiver 5 is a heat recovery portion 5A that transmits heat of refrigerant in the power receiver 5 to refrigerant flowing in the suction pipe 16 to recover heat. The heat recovery portion 5A is disposed in the power receiver 5.

In the example illustrated in FIG. 1, the heat recovery portion 5A is shaped so that the heat recovery portion 5A extends from an upper portion to a lower portion in the power receiver 5, horizontally extends in the power receiver 5, and then extends from the lower portion to the upper portion of the power receiver 5. However, the shape of the heat recovery portion 5A is not limited to this example. The heat recovery portion 5A may have a helical shape in the power receiver 5, for example. In this case, the amount of heat exchange between refrigerant in the power receiver 5 and refrigerant in the heat recovery portion 5A can be increased. The heat recovery portion 5A may extend to a bottom portion of the power receiver 5, for example. In this case, the heat recovery portion 5A is easily immersed in liquid refrigerant so that the amount heat exchange between refrigerant in the power receiver 5 and refrigerant in the heat recovery portion 5A can be increased.

(Outdoor Heat Exchanger 7)

In a heating operation, the outdoor heat exchanger 7 serves as an evaporator and exchanges heat between refrigerant that has flowed out of the second expansion valve 6 and air. In a cooling operation, the outdoor heat exchanger 7 serves as a condenser and exchanges heat between refrigerant discharged from the compressor 1 and air. The outdoor heat exchanger 7 is connected to the second expansion valve 6 through the refrigerant pipe 50C at one end and is connected to the four-way valve 2 through the refrigerant pipe 50D at the other end. In a manner similar to the indoor heat exchanger 3*a* and the indoor heat exchanger 3*b*, the outdoor heat exchanger 7 is preferably a plate fin-and-tube heat exchanger that can exchange heat between refrigerant flowing in the indoor heat exchanger 3*a* and the indoor heat exchanger 3*b* and air passing through fins.

The outdoor heat exchanger 7 includes a header-type distributor 7A. The header-type distributor 7A is attached to a refrigerant inflow end (inlet end) of the outdoor heat exchanger 7, and is used for distributing refrigerant supplied to the outdoor heat exchanger 7 to a plurality of refrigerant channels. The outdoor heat exchanger 7 includes the header-type distributor 7A so that uneven distribution of the refrigerant in the outdoor heat exchanger 7 due to multi-path distribution can be reduced, and degradation of performance of the outdoor heat exchanger 7 can be reduced.

In the example illustrated in FIG. 1, the header-type distributor 7A is provided to the outdoor heat exchanger 7. Alternatively, the header-type distributor 7A may be provided to each of the indoor heat exchanger 3*a* and the indoor heat exchanger 3*b*. With this configuration, similar advantages can also be obtained when the indoor heat exchanger 3*a* and the indoor heat exchanger 3*b* serve as evaporators (in the cooling operation).

(Suction Pipe 16)

The suction pipe 16 is connected to the four-way valve 2 at one end and is connected to the suction side of the compressor 1 at the other end. The suction pipe 16 is partially disposed in the power receiver 5. Specifically, the suction pipe 16 extends into the power receiver 5, extends out of the power receiver 5, and is then connected to the suction side of the compressor 1.

The suction pipe 16 includes a suction-side power receiver inlet pipe 16A connected to the four-way valve 2 at one end and connected to the heat recovery portion 5A at the other end and a suction-side power receiver outlet pipe 16B connected to the heat recovery portion 5A at one end and connected to the suction side of the compressor 1 at the other end. That is, in the suction pipe 16, the suction-side power receiver inlet pipe 16A, the heat recovery portion 5A, and the suction-side power receiver outlet pipe 16B are connected in series in this order. The suction-side power receiver inlet pipe 16A is connected to the first bypass pipe 13.

(First Bypass Pipe 13)

The first bypass pipe 13 is connected to the power receiver 5 at one end and is connected to the suction pipe 16 at the other end. The first bypass pipe 13 is connected to the flow control valve 8. The first bypass pipe 13 and the suction pipe 16 are connected to each other at a location upstream of a portion of the suction pipe 16 disposed in the power receiver 5. In this manner, even when liquid refrigerant flows into the heat recovery portion 5A of the suction pipe 16 through the first bypass pipe 13, liquid refrigerant evaporates in the heat recovery portion 5A so that generation of liquid back is controlled.

(Flow Control Valve 8)

The flow control valve 8 is provided to the first bypass pipe 13 and used for adjusting the amount of refrigerant flowing in the first bypass pipe 13. Based on detection results of the first temperature sensor 31 and the second temperature sensor 32, the opening degree of the flow control valve 8 is controlled depending on a degree of superheat calculated by the control unit 20. By controlling the opening degree, the amount of gas refrigerant flowing into the suction pipe 16 through the first bypass pipe 13 is adjusted. In a manner similar to the first expansion valve 4 and the second expansion valve 6, the flow control valve 8 is preferably an electronic expansion valve having a variable opening degree, for example.

(Refrigerant Pipe 50A to Refrigerant Pipe 50D)

The refrigerant pipe 50A connects the four-way valve 2 to the indoor heat exchanger 3*a* and the indoor heat exchanger 3*b*. The refrigerant pipe 50A also connects the outdoor unit 100 to the indoor unit 200A and the indoor unit 200B. The refrigerant pipe 50B connects the indoor heat exchanger 3*a* and the indoor heat exchanger 3*b* to the first expansion valve 4. The refrigerant pipe 50B also connects the outdoor unit 100 to the indoor unit 200A and the indoor unit 200B. The refrigerant pipe 500 connects the second expansion valve 6 to the outdoor heat exchanger 7. The refrigerant pipe 50C is provided in the outdoor unit 100. The refrigerant pipe 50D connects the outdoor heat exchanger 7 to the four-way valve 2. The refrigerant pipe 500 is provided in the outdoor unit 100.

(Indoor-Side Power Receiver Pipe 14 and Outdoor-Side Power Receiver Pipe 15)

The indoor-side power receiver pipe 14 is connected to the first expansion valve 4 at one end and is connected to the power receiver 5 at the other end. This end of the indoor-side power receiver pipe 14 connected to the power receiver 5 is disposed in the power receiver 5. The end of the indoor-side power receiver pipe 14 disposed in the power receiver 5 is terminated at the bottom of the power receiver 5.

The outdoor-side power receiver pipe 15 is connected to the second expansion valve 6 at one end and is connected to the power receiver 5 at the other end. In a manner similar to the indoor-side power receiver pipe 14, the end of the outdoor-side power receiver pipe 15 connected to the power receiver 5 is disposed in the power receiver 5. The end of the outdoor-side power receiver pipe 15 disposed in the power receiver 5 is terminated at the bottom of the power receiver 5.

As illustrated in FIG. 1, the ends of the indoor-side power receiver pipe 14 and the outdoor-side power receiver pipe 15 disposed in the power receiver 5 are preferably located below the heat recovery portion 5A, for example. Because gas refrigerant lighter than liquid refrigerant is located above the power receiver 5, an inflow of gas refrigerant from the power receiver 5 into the indoor-side power receiver pipe 14 in a cooling operation can be controlled so that an increase in the degree of quality of refrigerant flowing into the indoor heat exchanger 3*a* and the indoor heat exchanger 3*b* serving as evaporators can be controlled. In a heating operation, an inflow of gas refrigerant from the power receiver 5 into the indoor-side power receiver pipe 14 is controlled so that an increase in the degree of quality of refrigerant flowing into the outdoor heat exchanger 7 serving as an evaporator can be controlled.

(Control Unit 20)

The control unit 20 controls a rotation speed (including operation/stop) of the compressor 1, rotation speeds (including operation/stop) of unillustrated air-sending units provided to the indoor heat exchanger 3*a*, the indoor heat exchanger 3*b*, and the outdoor heat exchanger 7, and opening degrees of the first expansion valve 4, the second expansion valve 6, and the flow control valve 8, for example. The control unit 20 is, for example, a control device such as a microcomputer. Based on a degree of superheat of refrigerant in the heat recovery portion 5A, the control unit 20 controls the opening degree of the flow control valve 8. The control unit 20 is electrically connected to the first temperature sensor 31 and the second temperature sensor 32 by wires or wirelessly. Based on detection results of these sensors, the control unit 20 calculates the degree of superheat of refrigerant in the heat recovery portion 5A.

In the example illustrated in FIG. 1, the control unit 20 is not provided in any of the outdoor unit 100, the indoor unit 200A, and the indoor unit 200B. However, the present invention is not limited to this example. The control unit 20 may be provided in one of the outdoor unit 100, the indoor unit 200A, and the indoor unit 200B.

(First Temperature Sensor 31 and Second Temperature Sensor 32)

The first temperature sensor 31 and the second temperature sensor 32 detect temperatures of refrigerant, and are used for calculating the degree of superheat in the control unit 20. The first temperature sensor 31 detects a refrigerant temperature at a location downstream of a portion of the suction-side power receiver inlet pipe 16A connected to the first bypass pipe 13. The second temperature sensor 32 detects a temperature of refrigerant flowing in the suction-side power receiver outlet pipe 16B.

The second temperature sensor 32 may be replaced by a temperature sensor 16C that detects a temperature at a lower part of a shell of the compressor 1. The degree of superheat can also be calculated by using the temperature sensor 16C for detecting the temperature at the lower part of the shell of the compressor 1 and the first temperature sensor 31.

The refrigerant temperature detected by the first temperature sensor 31 corresponds to a first refrigerant temperature, and the refrigerant temperature detected by the second temperature sensor 32 and the refrigerant temperature detected by the temperature sensor 160 each correspond to a second refrigerant temperature.

In the example of Embodiment 1, the degree of superheat is calculated by using the first temperature sensor 31 and the second temperature sensor 32 that can detect temperatures of portions of the suction pipe 16 upstream and downstream of the power receiver 5. However, the present invention is not limited to this example. For example, the second temperature sensor 32 may be replaced by a pressure sensor for detecting a pressure at a portion of the suction pipe 16 upstream of the power receiver 5 to calculate the degree of superheat. In this manner, the degree of superheat can also be calculated by detecting the refrigerant temperature at a portion of the suction pipe 16 upstream of the power receiver 5 and the refrigerant pressure at a portion of the suction pipe 16 upstream of the power receiver 5.

[Refrigerant Flow in Heating Operation and Cooling Operation]

The condenser is the outdoor heat exchanger 7 in the cooling operation, and is the indoor heat exchanger 3*a* and the indoor heat exchanger 3*b* in the heating operation. The evaporator is the indoor heat exchanger 3*a* and the indoor heat exchanger 3*b* in the cooling operation, and is the outdoor heat exchanger 7 in the heating operation. An operation of the air-conditioning apparatus 300 having such a configuration will be described below.

(Heating Operation)

Refrigerant gas that has been compressed in the compressor 1 into high-temperature high-pressure refrigerant flows into the indoor heat exchanger 3*a* and the indoor heat exchanger 3*b* along a solid line in the four-way valve 2, exchanges heat with indoor air to release heat to a room with an unillustrated air-sending unit such as a fan, and is condensed into high-temperature high-pressure liquid refrigerant. The high-temperature high-pressure liquid refrigerant is subjected to pressure reduction in the first expansion valve 4 to be two-phase refrigerant under an intermediate pressure. The two-phase refrigerant flows into the power receiver 5 through the indoor-side power receiver pipe 14 and is stored in the power receiver 5.

The two-phase refrigerant stored in the power receiver 5 exchanges heat with low-temperature gas refrigerant flowing in the suction pipe 16 constituting a part of the heat recovery portion 5A, and the liquid refrigerant comes to be under an intermediate pressure. The low-temperature gas refrigerant flows in the suction pipe 16 because refrigerant flowing in the suction pipe 16 passes through the outdoor heat exchanger 7 serving as an evaporator. Because gas refrigerant in the two-phase refrigerant stored in the power receiver 5 flows out through the first bypass pipe 13, the amount of gas refrigerant stored in the power receiver 5 decreases, so that an increase in flow rate of refrigerant flowing out of the power receiver 5 into the outdoor heat exchanger 7 (evaporator) through, for example, the outdoor-side power receiver pipe 15 is controlled and the degree of quality is reduced, thereby controlling a decrease in refrigeration cycle efficiency.

The liquid refrigerant that has flowed out of the power receiver 5 is subjected to pressure reduction in the second expansion valve 6, and becomes low-temperature low-pressure two-phase refrigerant. The two-phase refrigerant flows into the outdoor heat exchanger 7, is caused to exchange heat with outdoor air by an unillustrated air-sending unit such as a fan, receives heat from the outdoor air, and evaporates into low-temperature low-pressure gas refrigerant.

The low-temperature low-pressure gas refrigerant that has flowed out of the outdoor heat exchanger 7 flows into the suction pipe 16 through the four-way valve 2, and then is combined with refrigerant flowing in the first bypass pipe 13. The combined refrigerant flows into the heat recovery portion 5A of the power receiver 5, and exchanges heat with refrigerant in the power receiver 5. In this manner, when the combined refrigerant contains liquid refrigerant, gasification of the liquid refrigerant is promoted. The refrigerant that has flowed out of the heat recovery portion 5A is sucked from the suction side of the compressor 1.

(Cooling Operation)

Refrigerant gas that has been compressed in the compressor 1 into high-temperature high-pressure refrigerant flows into the outdoor heat exchanger 7 along a dotted line in the four-way valve 2, is caused to exchange heat with indoor air by an unillustrated air-sending unit such as a fan, releases heat to an outside of a room, and is condensed into high-temperature high-pressure liquid refrigerant. The high-temperature high-pressure liquid refrigerant is subjected to pressure reduction in the second expansion valve 6 to be two-phase refrigerant under an intermediate pressure. The two-phase refrigerant flows into the power receiver 5 through the outdoor-side power receiver pipe 15 and is stored in the power receiver 5.

The two-phase refrigerant stored in the power receiver 5 exchanges heat with low-temperature gas refrigerant flowing in the heat recovery portion 5A, and the liquid refrigerant comes to be under an intermediate pressure. The low-temperature gas refrigerant flows in the suction pipe 16 because refrigerant flowing in the suction pipe 16 passes through the indoor heat exchanger 3*a* and the indoor heat exchanger 3*b* serving as evaporators. Because gas refrigerant in the two-phase refrigerant stored in the power receiver 5 flows out through the first bypass pipe 13, the amount of gas refrigerant stored in the power receiver 5 decreases, so that an increase in flow rate of refrigerant flowing out of the power receiver 5 into the indoor heat exchanger 3*a* and the indoor heat exchanger 3*b* (evaporators) through, for example, the indoor-side power receiver pipe 14 and the degree of quality is reduced, thereby controlling a decrease in refrigeration cycle efficiency.

The liquid refrigerant that has flowed out of the power receiver 5 is subjected to pressure reduction in the first expansion valve 4 and becomes low-temperature low-pressure two-phase refrigerant. The two-phase refrigerant flows into the indoor heat exchanger 3*a* and the indoor heat exchanger 3*b*, is caused to exchange heat with indoor air by an unillustrated air-sending unit such as a fan, receives heat in the room, and evaporates into low-temperature low-pressure gas refrigerant.

The low-temperature low-pressure gas refrigerant that has flowed out of the indoor heat exchanger 3*a* and the indoor heat exchanger 3*b* flows into the suction pipe 16 through the four-way valve 2, and then is combined with refrigerant flowing in the first bypass pipe 13. The combined refrigerant flows into the heat recovery portion 5A in the power receiver 5, and exchanges heat with refrigerant in the power receiver 5. In this manner, when the combined refrigerant contains liquid refrigerant, gasification of the liquid refrigerant is promoted. The refrigerant that has flowed out of the heat recovery portion 5A is sucked from the suction side of the compressor 1.

[Control by Control Unit 20]

Figure 2:
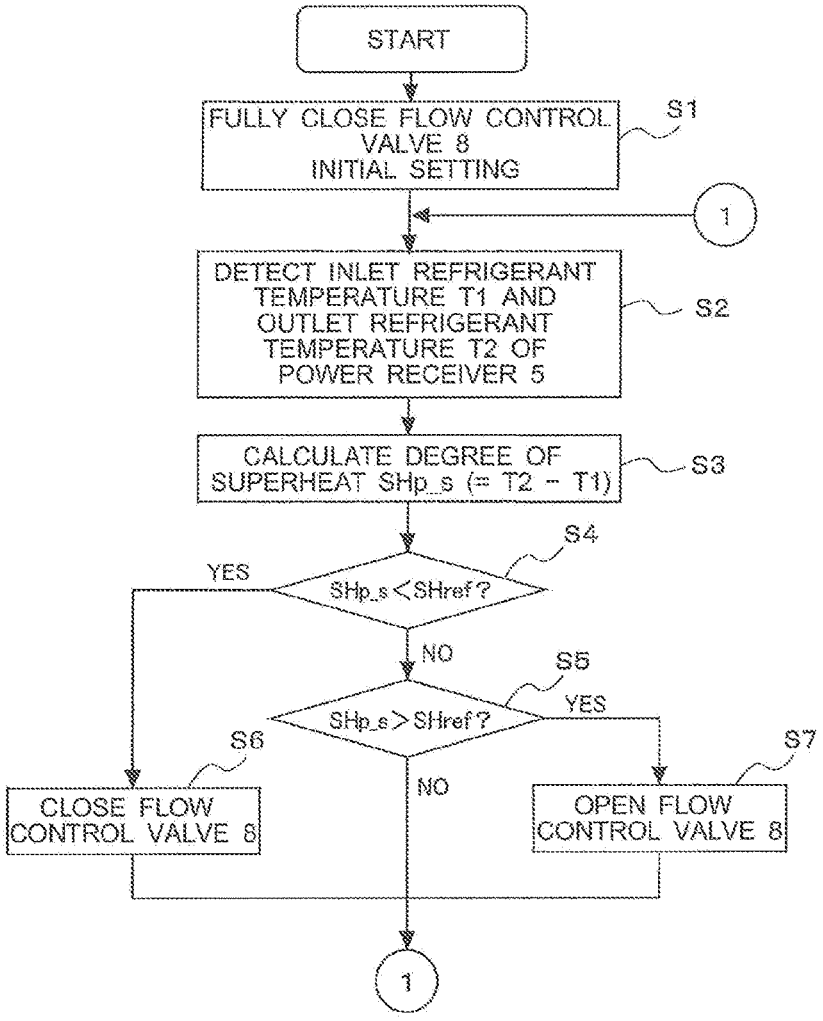
FIG. 2 is an example of a flow chart of control in the air-conditioning apparatus according to Embodiment 1 of the present invention.

FIG. 2 is an example of a flow chart of control in the air-conditioning apparatus 300 according to Embodiment 1. Referring to FIG. 2, control of an opening degree of the flow control valve 8 in the air-conditioning apparatus 300 will be described below.

(Start to Step S3)

The control unit 20 starts opening degree control of the flow control valve 8 (start). The control unit 20 fully closes the flow control valve 8 (step S1). The control unit 20 calculates refrigerant temperatures based on outputs of the first temperature sensor 31 and the second temperature sensor 32 (step S2). Based on the refrigerant temperatures of the first temperature sensor 31 and the second temperature sensor 32 calculated in step S2, the control unit 20 calculates a degree of superheat SHp_s (step S3). Specifically, the degree of superheat SHp_s is calculated by subtracting a value of a refrigerant temperature T1 in the first temperature sensor 31 from a refrigerant temperature T2 in a second temperature sensor 32.

(Step S4)

The control unit 20 determines whether the degree of superheat SHp_s is lower than a predetermined value SHref or not (step S4). If the degree of superheat SHp_s is lower than the predetermined value SHref, the process proceeds to step S6, and otherwise, proceeds to step S5.

(Step S5)

The control unit 20 determines whether the degree of superheat SHp_s is higher than the value SHref or not (step S5). If the degree of superheat SHp_s is higher than the predetermined value SHref, the process proceeds to step S7, and otherwise, returns to step S2.

(Step S6)

If the control unit 20 determines that the degree of superheat SHp_s is lower than the predetermined value SHref in step S4, the control unit 20 reduces the opening degree of the flow control valve 8 (step S6). In step S6, the opening degree is controlled to be lower than the current opening degree of the flow control valve 8, and the flow control valve 8 does not need to be fully closed. The degree of reduction of the opening degree is preferably set depending on, for example, a difference between the degree of superheat SHp_s and the predetermined value SHref.

(Step S7)

If the control unit 20 determines that the degree of superheat SHp_s is higher than the predetermined value SHref in step S5, the control unit 20 increases the opening degree of the flow control valve 8 (step S7). In step S7, the opening degree is controlled to be higher than the current opening degree of the flow control valve 8, and the flow control valve 8 does not need to be fully opened. The degree of increase of the opening degree is preferably set depending on, for example, a difference between the degree of superheat SHp_s and the predetermined value SHref.

[Advantages of Air-Conditioning Apparatus 300 of Embodiment 1]

(1) In step S7 described above, the opening degree of the flow control valve 8 is increased to promote discharge of gas refrigerant accumulated in the power receiver 5. In this manner, supply of gas refrigerant to a downstream portion of the power receiver 5 is controlled, and refrigerant (liquid refrigerant) that has been sufficiently subcooled can be supplied.

More specifically, in the heating operation, refrigerant (liquid refrigerant) that has been subcooled by a predetermined degree is supplied to the second expansion valve 6 downstream of the power receiver 5. Thus, a sufficient amount of heat exchange is assured between liquid refrigerant supplied to the outdoor heat exchanger 7 and air. In the cooling operation, refrigerant (liquid refrigerant) that has been subcooled by a predetermined degree is supplied to the first expansion valve 4 downstream of the power receiver 5. Thus, a sufficient amount of heat exchange is assured between liquid refrigerant supplied to the indoor heat exchanger 3*a* and the indoor heat exchanger 3*b* and air. In this manner, in the cooling operation and the heating operation, a sufficient amount of heat exchange in the evaporator can be obtained so that a decrease in efficiency of the refrigeration cycle in the air-conditioning apparatus 300 can be controlled.

(2) In addition, it is possible to further promote discharge of gas refrigerant accumulated in the power receiver 5, thereby controlling an increase in the refrigerant flow rate in the evaporator downstream of the power receiver 5. That is, an increase in the refrigerant flow rate in the evaporator is controlled so that a pressure loss in the evaporator can be reduced, thereby controlling a decrease in efficiency of the refrigeration cycle in the air-conditioning apparatus 300.

(3) Furthermore, it is possible to further promote discharge of gas refrigerant accumulated in the power receiver 5 so that an increase in the amount of gas refrigerant flowing from the power receiver 5 into the evaporator can be controlled. In this manner, an increase in the degree of quality of refrigerant flowing into the evaporator can be controlled, and a decrease in efficiency of the refrigeration cycle in the air-conditioning apparatus 300 can be reduced.

The evaporator herein corresponds to the outdoor heat exchanger 7 in the heating operation, and corresponds to the indoor heat exchanger 3*a* and the indoor heat exchanger 3*b* in the cooling operation.

In step S7 described above, the opening degree of the flow control valve 8 is increased to enhance performance of the evaporator. However, an excessively high opening degree of the flow control valve 8 may excessively increase the amount of liquid refrigerant flowing out of the evaporator so that liquid refrigerant that failed to be gasified in the heat recovery portion 5A flows into the suction side of the compressor 1 in some cases. To prevent such a situation, the opening degree of the flow control valve 8 is reduced in step S6, thereby controlling occurrence of liquid back.

The air-conditioning apparatus 300 according to Embodiment 1 includes a header-type distributor 7A provided to the outdoor heat exchanger 7. Thus, as described above, since an increase in the degree of quality is controlled in step S7, distribution performance of two-phase refrigerant supplied to the outdoor heat exchanger 7 in the heating operation is enhanced. That is, in the air-conditioning apparatus 300 according to Embodiment 1, enhanced distribution performance can increase the heat exchange efficiency in the outdoor heat exchanger 7 so that a decrease in the efficiency of the refrigeration cycle is controlled.

The air-conditioning apparatus 300 according to Embodiment 1 includes the heat recovery portion 5A and connects the end of the first bypass pipe 13 connected to the suction pipe 16 to a portion of the suction pipe 16 located between the four-way valve 2 and the heat recovery portion 5A. Thus, even when liquid refrigerant flows into the suction-side power receiver inlet pipe 16A, the liquid refrigerant flows into the heat recovery portion 5A, receives heat from refrigerant accumulated in the power receiver 5, and evaporates and gasified. Accordingly, even when liquid refrigerant flows into the first bypass pipe 13, the air-conditioning apparatus 300 according to Embodiment 1 can control an inflow of liquid refrigerant into the suction side of the compressor 1, thereby controlling damage of the compressor 1. That is, the air-conditioning apparatus 300 according to Embodiment 1 can obtain reliability of the compressor 1.

Embodiment 2

Figure 3:
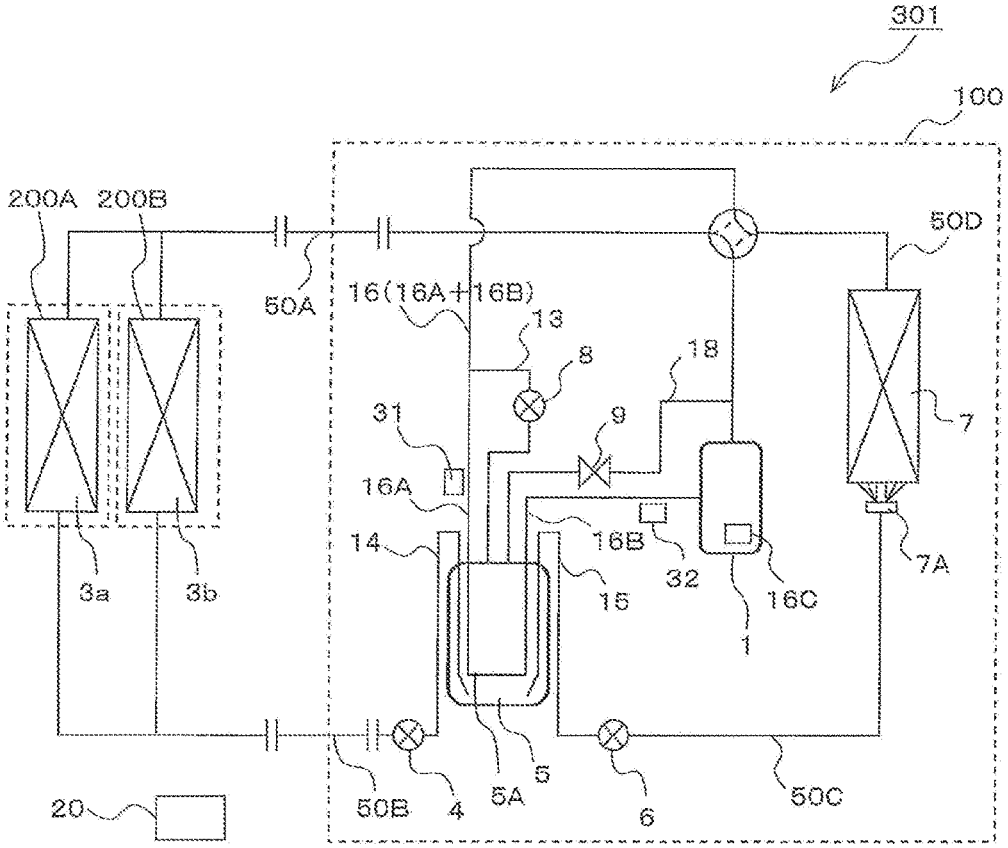
FIG. 3 illustrates an example of a refrigerant circuit configuration of an air-conditioning apparatus according to Embodiment 2 of the present invention.

FIG. 3 illustrates an example of a refrigerant circuit configuration of an air-conditioning apparatus 301 according to Embodiment 2. In Embodiment 2, the same reference signs designate the same parts in Embodiment 1, and the following description will be mainly based on differences from Embodiment 1. In Embodiment 1 above, the circuit configuration using the power receiver 5 having the gas-liquid separation function has been used to enhance performance. In Embodiment 2, enhancement of performance when oil takeout amount of the compressor 1 is large and the oil return performance to a compressor 1 is poor is taken into consideration.

In addition to the configuration of Embodiment 1, the air-conditioning apparatus 301 of Embodiment 2 includes a second bypass pipe 18 connected to an upper portion of the power receiver 5, in a manner similar to the first bypass pipe 13. The second bypass pipe 18 is connected to an oil return valve 9. The second bypass pipe 18 is connected to an upper portion of the power receiver 5 at one end, and is connected to a discharge side of the compressor 1 at the other end. In this manner, refrigerating machine oil that has flowed out of the discharge side of the compressor 1 returns to the power receiver 5 through the second bypass pipe 18. Then, the refrigerating machine oil that has returned to the power receiver 5 returns to the compressor 1 through the first bypass pipe 13 and the suction pipe 16.

In the example above, the second bypass pipe 18 is connected to the upper portion of the power receiver 5 at one end. However, the present invention is not limited to this example, and the end of the second bypass pipe 18 may be connected to the suction-side power receiver inlet pipe 16A or the suction-side power receiver outlet pipe 16B. In this case, refrigerating machine oil can also return to the compressor 1.

In the example of FIG. 3, the oil return valve 9 is an electric shut-off valve for opening and closing a channel of the second bypass pipe 18. However, the present invention is not limited to this example, and the oil return valve 9 may be an electric regulating valve that can adjust the opening degree as well as opening and closing.

In addition, in FIG. 3, no oil separator is provided. Alternatively, in addition to the second bypass pipe 18 and the oil return valve 9, an oil separator may be provided at a discharge side of the compressor 1 and combined with the second bypass pipe 18 and the oil return valve 9.

Figure 4:
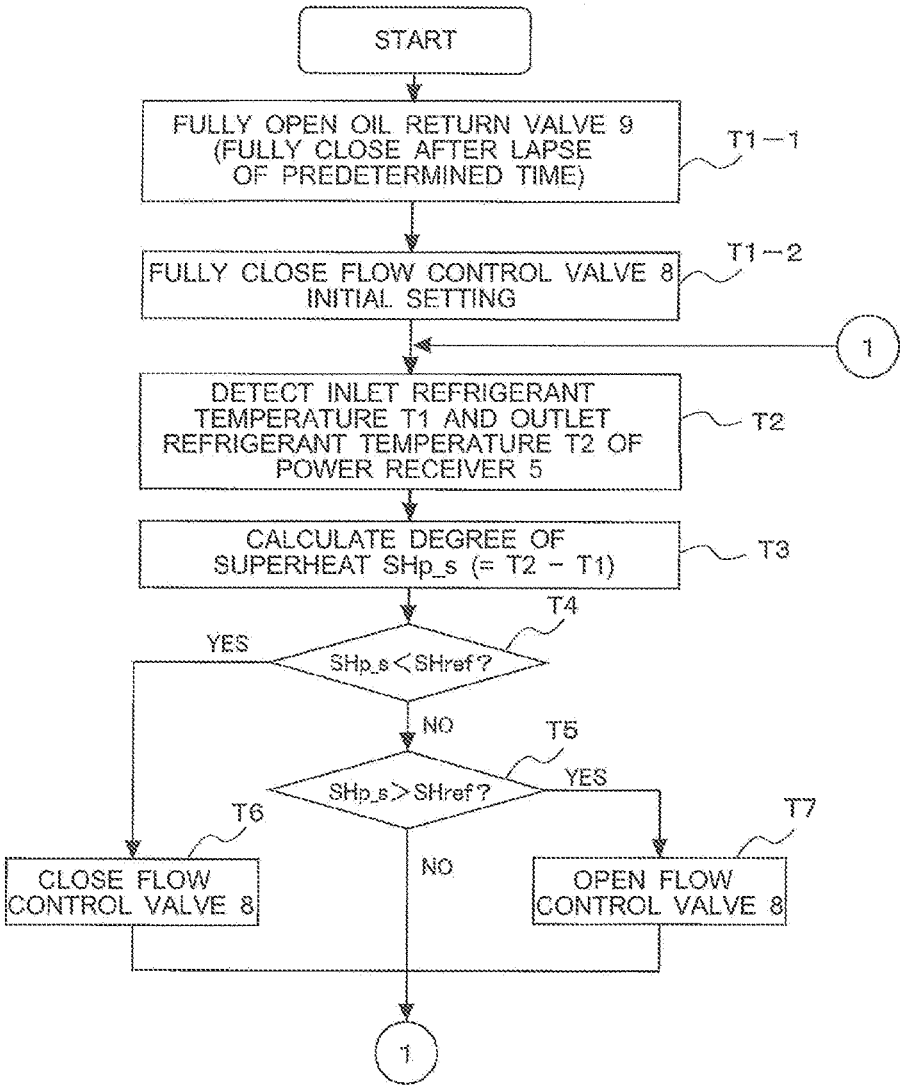
FIG. 4 is an example of a flow chart of control in the air-conditioning apparatus according to Embodiment 2 of the present invention.

FIG. 4 is an example of a flow chart of control in the air-conditioning apparatus 301 according to Embodiment 2. FIG. 4 is different from FIG. 2 in that step T1-1 is not included in the control shown in FIG. 2, and the other steps T1-2 to T7 are similar to steps S1 to S7 in FIG. 2. Thus, description of step T1-2 to step T7 will not be repeated.

(Step T-1)

The control unit 20 opens (fully opens) the oil return valve 9. After a lapse of a predetermined time, the control unit 20 closes (fully closes) the oil return valve 9.

[Advantage of Air-Conditioning Apparatus 301 of Embodiment 2]

The air-conditioning apparatus 301 according to Embodiment 2 has the following advantage as well as those of the air-conditioning apparatus 300 according to Embodiment 1. Since the air-conditioning apparatus 301 according to Embodiment 2 includes the second bypass pipe 18 and the oil return valve 9, refrigerating machine oil that has flowed out of the compressor 1 is easily caused to return to the compressor 1.

As illustrated in FIG. 2 of Embodiment 1 and FIG. 4 of Embodiment 2, in the example described above, the degree SHref in step S4 is equal to that in step S5, and the degree SHref in step T4 is also equal to that in step T5. That is, if the degree of superheat SHp_s is equal to SHref, the opening degree control of the flow control valve 8 is not performed in the example above. However, the present invention is not limited to this example.

For example, a predetermined first value SHref1 may be used in step S4 with a predetermined second value SHref2 being used in step S5. Alternatively, a predetermined first value SHref1 may be used in step T4 with a predetermined second value SHref2 being used in step T5. Here, it is assumed that SHref1<SHref2. In this case, if the calculated degree of superheat SHp_s satisfies SHref1≤SHp_s≤SHref2, the opening degree control of the flow control valve 8 is not performed. In this manner; the degree of superheat SHp_s when the opening degree control of the flow control valve 8 is not performed has a margin so that operations of the air-conditioning apparatus 300 and the air-conditioning apparatus 301 are expected to be further stabilized.

REFERENCE SIGNS LIST

1 compressor, 2 four-way valve, 3*a* indoor heat exchanger, 3*b* indoor heat exchanger, 4 first expansion valve, 5 power receiver, 5A heat recovery portion, 6 second expansion valve, 7 outdoor heat exchanger, 7A header-type distributor, 8 flow control valve, 9 oil return valve, 13 first bypass pipe, 14 indoor-side power receiver pipe, 15 outdoor-side power receiver pipe, 16 suction pipe, 16A suction-side power receiver inlet pipe, 16B suction-side power receiver outlet pipe, 160 temperature sensor, 18 second bypass pipe, 20 control unit, 31 first temperature sensor, 32 second temperature sensor, 50A refrigerant pipe, 50B refrigerant pipe, 50C refrigerant pipe, 50D refrigerant pipe, 100 outdoor unit, 200A indoor unit, 200B indoor unit, 300 air-conditioning apparatus, 301 air-conditioning apparatus, SHp_s degree of superheat, T1 refrigerant temperature, T2 refrigerant temperature

The invention claimed is:

1. An air-conditioning apparatus comprising:

a refrigeration cycle connecting a compressor, a condenser, an expansion valve, and an evaporator by refrigerant pipes;

a suction pipe having one end connected to a suction side of the compressor and another end connected to the evaporator;

a receiver connected to a refrigerant pipe connecting the evaporator and the condenser to each other;

a first bypass pipe having one end connected to the receiver and another end connected to the suction pipe and configured to supply refrigerant from the receiver to the suction pipe;

a flow control valve provided to the first bypass pipe;

a heat recovery portion disposed downstream of a portion of the suction pipe connected to the first bypass pipe and configured to exchange heat between refrigerant flowing into the suction pipe from the evaporator and the first bypass pipe and refrigerant in the receiver; and a control device configured to control an opening degree of the flow control valve based on a degree of superheat of refrigerant in the heat recovery portion, wherein the control device is configured to control the opening degree of the flow control valve based on the degree of superheat calculated from a first refrigerant temperature at a location downstream of the portion of the suction pipe connected to the first bypass pipe and upstream of the heat recovery portion and a second refrigerant temperature at a location downstream of the heat recovery portion.

2. The air-conditioning apparatus of claim 1, wherein the heat recovery portion is a part of the suction pipe disposed in the receiver.

3. The air-conditioning apparatus of claim 1, wherein the control device is configured to increase the opening degree of the flow control valve when the degree of superheat is larger than a predetermined value.

4. The air-conditioning apparatus of claim 1, wherein the control device is configured to reduce the opening degree of the flow control valve when the degree of superheat is smaller than a predetermined value.

5. The air-conditioning apparatus of claim 1, further comprising:

a temperature sensor disposed at a lower part of a shell of the compressor and configured to detect the second refrigerant temperature.

6. An air-conditioning apparatus comprising:

a refrigeration cycle connecting a compressor, a condenser, an expansion valve, and an evaporator by refrigerant pipes;

a suction pipe having one end connected to a suction side of the compressor and another end connected to the evaporator;

a receiver connected to a refrigerant pipe connecting the evaporator and the condenser to each other;

a first bypass pipe having one end connected to the receiver and another end connected to the suction pipe and configured to supply refrigerant from the receiver to the suction pipe;

a flow control valve provided to the first bypass pipe;

a heat recovery portion disposed downstream of a portion of the suction pipe connected to the first bypass pipe and configured to exchange heat between refrigerant flowing into the suction pipe from the evaporator and the first bypass pipe and refrigerant in the receiver; and a control device configured to control an opening degree of the flow control valve based on a degree of superheat of refrigerant in the heat recovery portion, wherein the control device is configured to control the opening degree of the flow control valve based on the degree of superheat calculated from a refrigerant temperature and a refrigerant pressure at a location downstream of the portion of the suction pipe connected to the first bypass pipe and upstream of the heat recovery portion.

7. The air-conditioning apparatus of claim 6, wherein the heat recovery portion is a part of the suction pipe disposed in the receiver.

8. The air-conditioning apparatus of claim 6, wherein the control device is configured to increase the opening degree of the flow control valve when the degree of superheat is larger than a predetermined value.

9. The air-conditioning apparatus of claim 6, wherein the control device is configured to reduce the opening degree of the flow control valve when the degree of superheat is smaller than a predetermined value.

10. An air-conditioning apparatus comprising:

a refrigeration cycle connecting a compressor, a condenser, an expansion valve, and an evaporator by refrigerant pipes;

a suction pipe having one end connected to a suction side of the compressor and another end connected to the evaporator;

a receiver connected to a refrigerant pipe connecting the evaporator and the condenser to each other;

a first bypass pipe having one end connected to the receiver and another end connected to the suction pipe and configured to supply refrigerant from the receiver to the suction pipe;

a flow control valve provided to the first bypass pipe;

a heat recovery portion disposed downstream of a portion of the suction pipe connected to the first bypass pipe and configured to exchange heat between refrigerant flowing into the suction pipe from the evaporator and the first bypass pipe and refrigerant in the receiver;

a control device configured to control an opening degree of the flow control valve based on a degree of superheat of refrigerant in the heat recovery portion;

a second bypass pipe having one end connected to a discharge side of the compressor and another end connected to the receiver; and an oil return valve provided to the second bypass pipe.

11. The air-conditioning apparatus of claim 10, wherein the control device is configured to open the oil return valve for a predetermined time and then control the opening degree of the flow control valve based on the degree of superheat.

12. The air-conditioning apparatus of claim 10, wherein the heat recovery portion is a part of the suction pipe disposed in the receiver.

13. The air-conditioning apparatus of claim 10, wherein the control device is configured to increase the opening degree of the flow control valve when the degree of superheat is larger than a predetermined value.

14. The air-conditioning apparatus of claim 10, wherein the control device is configured to reduce the opening degree of the flow control valve when the degree of superheat is smaller than a predetermined value.

* * * * *